US007219527B2

(12) United States Patent
Yogo

(10) Patent No.: US 7,219,527 B2
(45) Date of Patent: May 22, 2007

(54) MANDREL FOR BENDING

(75) Inventor: Teruaki Yogo, Seto (JP)

(73) Assignee: Kabushiki Kaisha Opton, Seto-shi, Aichi (JP)

( * ) Notice: Subject to any disclaimer, the term of this patent is extended or adjusted under 35 U.S.C. 154(b) by 351 days.

(21) Appl. No.: 10/869,485

(22) Filed: Jun. 16, 2004

(65) Prior Publication Data

US 2004/0256095 A1 Dec. 23, 2004

(30) Foreign Application Priority Data

Jun. 19, 2003 (JP) ..... 2003-175100

(51) Int. Cl.
*B21D 9/03* (2006.01)
*B21D 9/16* (2006.01)

(52) U.S. Cl. ..... 72/466.2; 72/466; 72/369

(58) Field of Classification Search ..... 72/466, 72/466.2, 369

See application file for complete search history.

(56) References Cited

U.S. PATENT DOCUMENTS

| | | | | |
|---|---|---|---|---|
| 1,748,158 | A * | 2/1930 | Walp | 72/466 |
| 1,856,597 | A * | 5/1932 | St Jarnstrom | 72/466 |
| 2,451,717 | A | 10/1948 | Check, Sr. | |
| 2,776,697 | A * | 1/1957 | Zerlaut | 72/466 |
| 3,105,538 | A | 10/1963 | Spates | |
| 3,417,601 | A | 12/1968 | Werner | |
| 3,572,083 | A | 3/1971 | Schmitt | |
| 4,378,689 | A * | 4/1983 | Molz | 72/466 |
| 4,647,255 | A | 3/1987 | Pow | |
| 6,244,092 | B1 | 6/2001 | Grobbenhaar | |

FOREIGN PATENT DOCUMENTS

| | | |
|---|---|---|
| DE | 562 804 | 10/1932 |
| JP | 6-41921 | 6/1994 |
| JP | 7-290156 | 11/1995 |

* cited by examiner

*Primary Examiner*—David Jones
(74) *Attorney, Agent, or Firm*—Davis Bujold & Daniels, P.L.L.C.

(57) ABSTRACT

A mandrel for bending which inhibits generation of irregularities on the inside of the bend is provided. The mandrel comprises a plurality of plugs in the form of discs and a through-hole is created substantially in the center of each plug. A flexible member is inserted through the through-holes of the respective plugs. One end of the flexible member is fixed to a shank so that the plugs are connected to the shank in series. Each plug is provided with a flat slant surface that descends from about the center of the plug toward the outer periphery of the plug. A lock hole is formed in parallel to the through hole in each plug and a flexible lock member, one end of which is fixed to the shank, is passed through the lock holes of the respective plugs.

4 Claims, 4 Drawing Sheets

MANDREL FOR BENDING

FIELD OF THE INVENTION

This invention relates to a mandrel for bending which inhibits formation of irregularities at a bending part of a pipe during the bending process.

BACKGROUND OF THE INVENTION

Unexamined Japanese Utility Model Publication No. 6-41921 and Unexamined Japanese Patent Publication No. 7-290156 disclose a known conventional mandrel for bending comprising a plurality of plugs coupled in series onto an end of a shank. As can be seen in FIG. 4, the outer peripheral surface of each plug 50 is formed to be spherical and a connection shaft 52 is inserted through the center of the plug 50. The connection shaft 52 is provided with a spherical part 54 at one end and a spherical depression 56 at the other end.

The spherical part 54 of the connection shaft 52 is fitted into the spherical depression 56 of another connection shaft 52, which thus constitutes an adjustable joint. In this manner, a plurality of plugs 50 are connected in series. Moreover, the shank 58 is provided with a spherical depression 60 which is identical to the spherical depression 56. The spherical part 54 of the terminal connection shaft 52 is fitted into the depression 60 so that all the plugs 50 are connected to the shank 58.

When bending is performed, the plugs 50 are inserted into a pipe 62 to be arranged at the bending part. While the bending is performed, the spherical parts 54 rotate within the spherical depressions 56, 60 and the plugs 50 are waggled along the bending direction. As a result, spaces between the respective plugs 50 are narrowed and the outer peripheral surfaces of the plugs 50 are abutted to the inner wall of the pipe 62 in a concentrated manner on the inside of the bend.

Thus, formation of irregularities, such as wrinkles, on the inside of the bend is inhibited.

SUMMARY OF THE INVENTION

However, as shown in FIG. 4, in the case of bending using the conventional mandrel as above, a small gap G is left between the neighboring plugs 50 on the inside of the bend, where the outer peripheral surfaces of the respective plugs 50 do not abut the inner wall of the pipe 62. Therefore, during bending, especially during small radius bending, wrinkles are formed in this gap G.

There is a problem that the generation of irregularities cannot sufficiently be inhibited.

One object of the present invention is to provide a mandrel for bending which effectively inhibits formation of irregularities, such as wrinkles, in a pipe on the inside of the bend during the bending process.

To attain this and other objects, the present invention provides a mandrel for bending which inhibits generation of irregularities in a pipe by arranging plugs at a bending part within the pipe. Each plug is formed into a disc and a through-hole is created approximately in the center of the plug. A flexible member is inserted through the through-holes of a plurality of plugs. One end of the flexible member is fixed to a shank so that the plurality of plugs are connected to the shank in series. Each plug is provided with a slant surface which descends from about the center of the plug toward the outer periphery of the plug so that the peripheral side of the plug becomes thinner than the central side of the plug.

In the mandrel for bending of the present invention, the slant surface of the plug abuts a back surface of the adjoining plug and thus a plurality of plugs are closely abutted to each other without leaving a space. Therefore, formation of irregularities like wrinkles can be effectively inhibited while the pipe is being bent.

The slant surface may be a flat descending surface which extends from about the center of the plug toward the outer periphery of the plug. Also, the mandrel for bending may be provided with a turn lock mechanism which restricts rotation of the respective plugs within the pipe. The turn lock mechanism, for example, may comprise a flexible turn lock member. The turn lock member is passed through a lock hole provided in parallel to the previously described through-hole in each plug and is secured to the shank at one end. Moreover, the flexible member may be made of wire and a retaining member may be attached to the other end of the flexible member opposite to the shank.

BRIEF DESCRIPTION OF THE DRAWING FIGURES

The invention will now be described, by way of example, with reference to the accompanying drawings, in which.

DETAILED DESCRIPTION OF THE INVENTION

Figure 1:
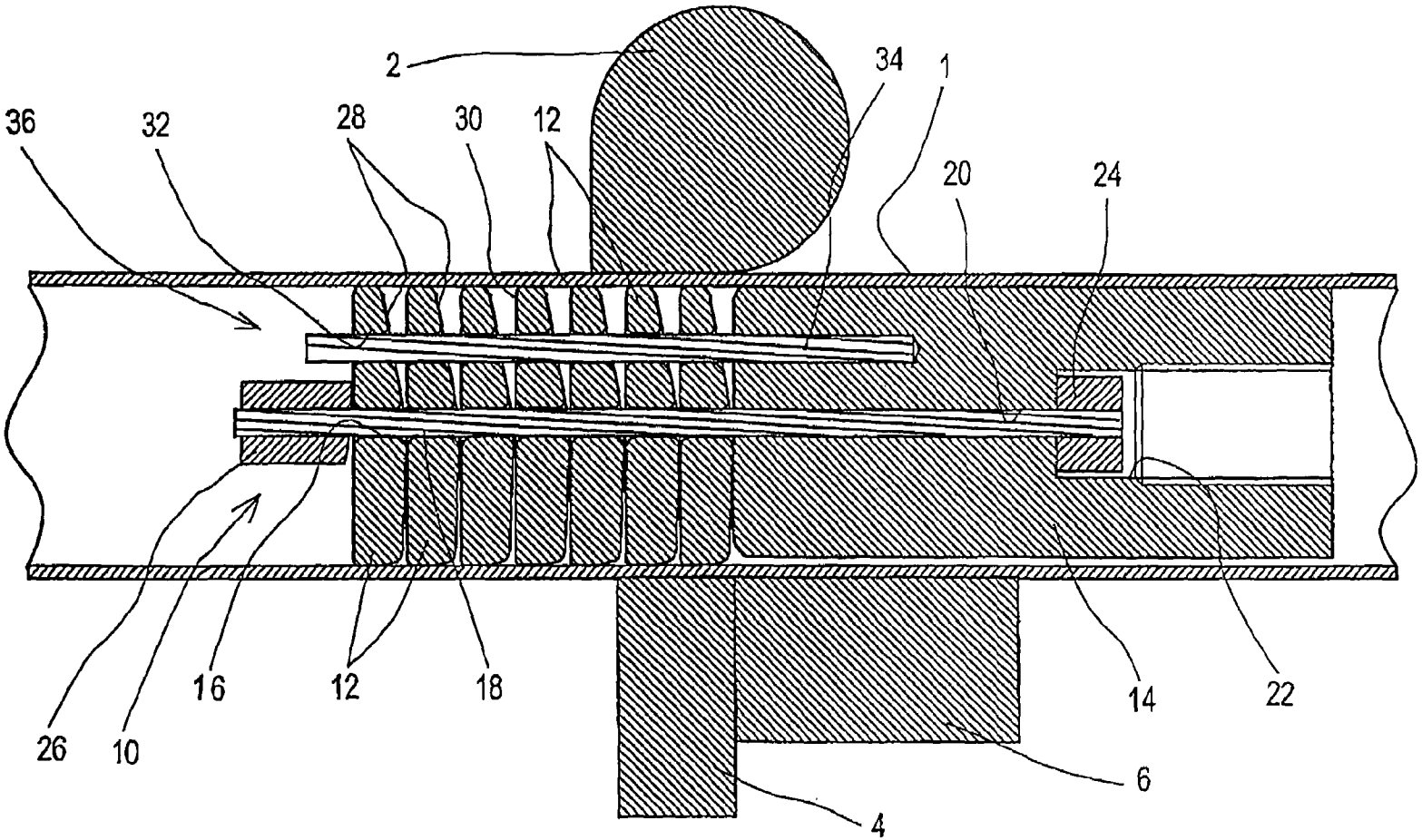
FIG. 1 is a cross-sectional view of a mandrel for bending according to an embodiment of the present invention before bending.

As shown in FIG. 1, a pipe 1 is arranged to be brought into contact with the outer periphery of a bend die 2 which is designed to bend the pipe 1 at a desired angle. Facing to the bend die 2, a clamp die 4 is provided so that the pipe 1 is held between the bend die 2 and the clamp die 4. While the bending is performed, the bend die 2 rotates and the clamp die 4 moves around the bend die 2. A pressure die 6 is also provided in line with the clamp die 4. The pressure die 6 receives bending reaction force induced while the pipe 1 is being bent.

Figure 2:
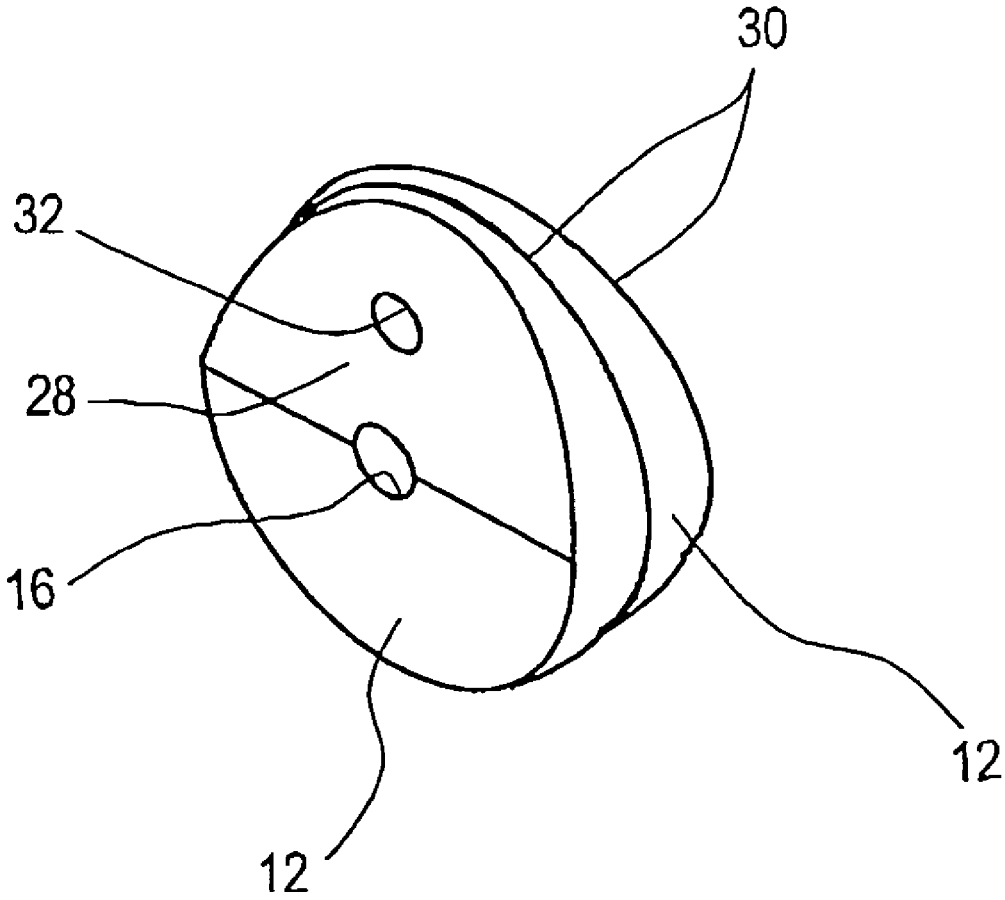
FIG. 2 is a perspective view of plugs of the embodiment.

A mandrel 10 for bending is inserted into the pipe 1. The mandrel 10 is composed of a plurality of plugs 12 and a shank 14. Each plug 12 is formed into a disc, as shown in FIG. 2. The outer peripheral surface of the plug 12 is formed to be spherical. The outer peripheral surface may be flat if the plug 12 is small in thickness.

A through-hole 16 is formed approximately in the center of each disc-like plug 12. A flexible member 18 is passed through the through-holes 16 of a plurality of plugs 12 arranged in stacks. The flexible member 18 is made of material which is easy to yield. In the present embodiment, the flexible member 18 is made of metal or plastic wire.

The flexible member 18 is inserted through an insertion hole 20 formed in the shank 14. The shank 14 is also provided with a large-diameter hole 22 which communicates with the insertion hole 20. To the end of the flexible member 18 which projects from the insertion hole 20 into the large-diameter hole 22, a retaining member 24 is attached.

Also to the other end of the flexible member 18 opposite to the shank 14, a retaining member 26 is attached. Between the retaining member 26 and the shank 14, a plurality of plugs 12 are held in a row. No tension is required to be applied to the flexible member 18. The number of plugs 12 to be used can be determined at discretion according to the beading length of bending.

Each plug 12 is provided with a slant surface 28 on one side. The slant surface 28 descends from about the center of the plug 12 toward the outer periphery so that the plug 12 becomes partially thinner on the peripheral side than the central side. In the present embodiment, the slant surface 28 is not curved but flat.

Figure 3:
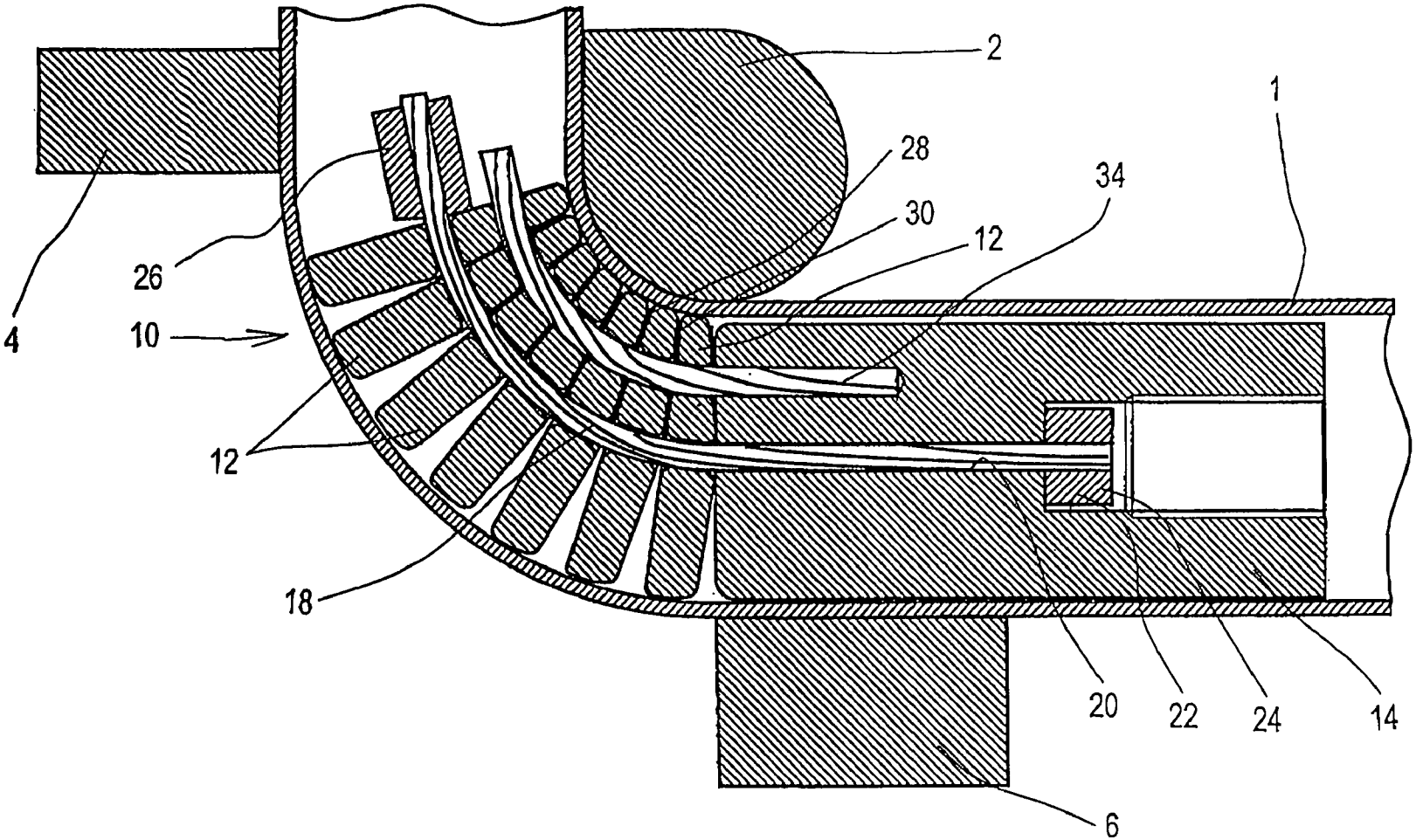
FIG. 3 is a cross-sectional view of the mandrel for bending according to the embodiment after bending.
Figure 4:
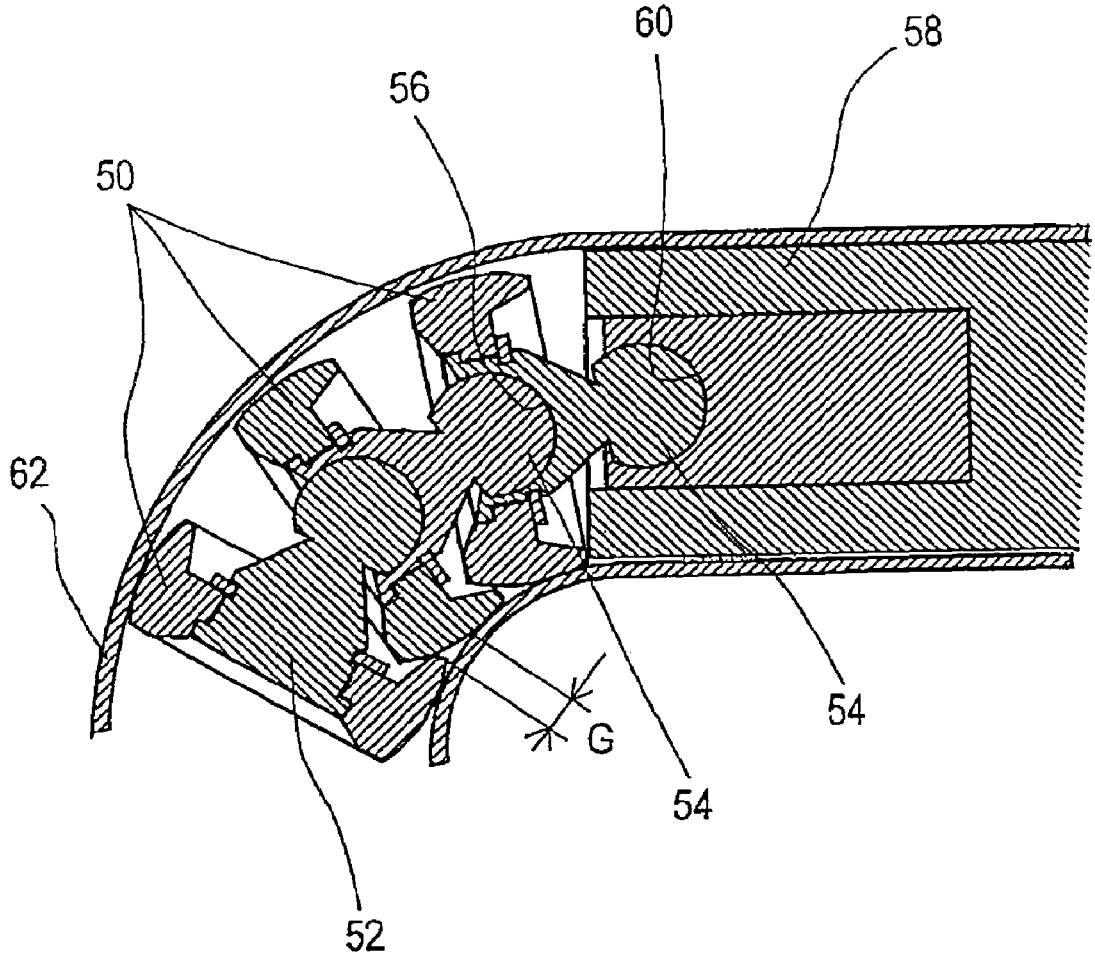
FIG. 4 is a cross-sectional view of a conventional mandrel for bending after bending.

As shown in FIG. 3, inclination of the slant surface 28 is so determined that a back surface 30 of the plug 12 abuts the slant surface 28 of the adjoining plug 12 and that a plurality of plugs 12 are brought into close contact with each other on the inside of the bend during the bending process. The back surface 30, which is on the reverse side where there is the slant surface 28, is formed entirely flat. Moreover, the front surface continuing into the slant surface 28, which faces to the outside of the bend when bending is performed, is formed subtly inclined. The plug 50 can be a shape of a cone having the through-hole 16 provided along the axis of the cone.

In each plug 12, a through lock hole 32 which opens to the slant surface 28 is provided in parallel to the through-hole 16. A turn lock member 34 is inserted into the lock holes 32 of the respective plugs 12. Similar to the flexible member 18, the turn lock member 34 is made of a flexible material, such as metal wire and plastic wire, for example. One end of the turn lock member 34 is inserted into the shank 14 and secured. In the present embodiment, the lock holes 32 and the turn lock member 34 constitute a turn lock mechanism 36. The turn lock mechanism 36 may be constituted in a manner other than the above-described constitution. For example, each plug 12 may be fixed to the flexible member 18 by caulking. Or, projections and depressions may be provided on the respective plugs 12 and the shank 14 so that the rotation of the plugs 12 can be avoided by engaging the projections and depressions.

Now, operation of the mandrel 10 for bending of the present invention will be explained.

Firstly, as shown in FIG. 1, a pipe 1 is held between the bend die 2 and the clamp die 4. The pressure die 6 is abutted to the pipe 1. Next, the mandrel 10 for bending comprising a plurality of plugs 12 is inserted into the pipe 1. At the time of the insertion, each plug 12 is disposed in such a manner that the peripheral side with the slant surface 28 faces to the inside of the bend.

While the bend die 2 is rotated on its axis, the clamp die 4 is rotated around the bend die 2. As a result, the pipe 1 is wound around the bend die 2, resulting in that the outside of the bend is stretched and the inside of the bend is compressed at the bending part of the pipe 1.

As shown in FIG. 3, in the mandrel 10 for bending, the spaces between the plugs 12 are expanded on the outside of the bend and are narrowed on the inside of the bend. Furthermore, the back surface 30 of the plug 12 abuts to the slant surface 28 of the adjoining plug 12. As a result, on the inside of the bend, the neighboring plugs 12 are closely abutted, leaving no space therebetween.

Consequently, even if the pipe 1 is compressed on the inside of the bend while the bending is performed, formation of irregularities like wrinkles cannot be promoted. Accordingly, even if the bending radius is small, bending free of irregularities can be achieved.

The present invention is not limited to the above embodiment, and other modifications and variations are possible within the scope of the present invention.

What is claimed is:

1. A mandrel for bending a pipe, the mandrel comprising:

a plurality of plugs with each of the plurality of plugs being in the form of a disc provided with a through-hole substantially in the center thereof, and a flexible member being inserted through the through-holes of the plurality of plugs, and one end of the flexible member being secured to a shank so that the plurality of plugs are connected in series to the shank, wherein each of the plurality of plug is provided with a slant surface which descends from about a center of the plug toward an outer periphery of the plug so that a peripheral portion of the plug becomes thinner than a central portion of the plug; and a turn lock mechanism for restricting rotation of each of the plurality of plugs, the turn lock mechanism comprises a flexible turn lock member which passes through a lock hole provided in each of the plurality of plugs and arranged parallel to the through hole, and the turn lock member is secured to the shank at one end.

2. The mandrel for bending as set forth in claim 1, wherein said slant surface is a flat descending surface which extends from adjacent the center of the plug toward the outer periphery of the plug.

3. The mandrel for bending set forth in claim 1, wherein said flexible member is made of wire and a retaining member is attached to one end of the flexible member opposite to the shank.

4. The mandrel for bending set forth in claim 1, wherein turn lock member is made of wire.

* * * * *